United States Patent [19]

Heizer, Jr.

[11] Patent Number: 4,611,433

[45] Date of Patent: Sep. 16, 1986

[54] VEHICLE-OPERATED GATE

[76] Inventor: Marshall B. Heizer, Jr., Rte. 1, Box 21, Rawlings, Va. 23876

[21] Appl. No.: 781,799

[22] Filed: Sep. 30, 1985

[51] Int. Cl.[4] ..... E05P 7/06

[52] U.S. Cl. ..... 49/242; 49/240; 49/364

[58] Field of Search ..... 49/240, 242, 262, 272, 49/273, 327, 364

[56] References Cited

U.S. PATENT DOCUMENTS

| | | | |
|---|---|---|---|
| 489,621 | 1/1893 | Williams . | |
| 605,748 | 6/1898 | Sawyer . | |
| 721,600 | 2/1908 | Patrick . | |
| 1,075,129 | 10/1913 | Stickley | 49/242 |
| 1,277,334 | 8/1918 | Miller . | |
| 1,367,843 | 2/1921 | Thurston | 49/242 |
| 1,609,369 | 12/1926 | Laird | 49/364 |
| 2,691,836 | 10/1954 | David | 49/364 |
| 2,693,043 | 11/1954 | Leake | 49/364 |
| 2,693,653 | 11/1954 | Dean | 49/364 |

*Primary Examiner*—William E. Lyddane
*Assistant Examiner*—Gerald A. Anderson
*Attorney, Agent, or Firm*—Norman B. Rainer

[57] ABSTRACT

A swinging gate apparatus is provided having a gate member which automatically opens by pressure applied to either side by an automobile or other vehicle. In opening, the gate member tilts upwardly so that the force of gravity causes it to close. The rate of opening and closing is controlled by the concertive action of spring means, motion dampening means, and a cam mechanism.

6 Claims, 7 Drawing Figures

VEHICLE-OPERATED GATE

BACKGROUND OF THE INVENTION

This invention relates to swinging gates and is more particularly concerned with gates adapted to be disposed across a roadway and which can be opened by pressure applied to either side of the gate, such as by an automobile or other vehicle, and which automatically closes.

In providing gates of the aforementioned type, a commonly encountered problem is that after the gate is opened, the automatic means for closing it goes into operation immediately after the gate is opened or after the pressure used to open it is released. Consequently, the vehicles intending to pass through the opened gate often do not have sufficient time to do so before the gate closes. As a result, the vehicle in passing through the gate is frequently struck by the gate as it is closing, resulting in damage to the vehicle or the gate or both. This problem is more severe in the case of long vehicles or combinations of vehicles such as trucks, tractors an trailers, farming equipment, etc.

It is accordingly an object of the present invention to provide a vehicle-operated automatically closing gate which permits vehicles to pass through without danger of being struck by the gate in closing.

It is another object of the invention to provide a gate of the foregoing object which opens rapidly and is held open for a predetermined period of time.

It is a further object of the present invention to provide a gate of the aforesaid nature which can be opened either automatically by a vehicle or manually by a person on foot.

It is a still another object of this invention to provide a gate of the aforesaid nature of rugged durable design amenable to low cost manufacture.

These objects and other objects and advantages of the invention will be apparent from the following description.

SUMMARY OF THE INVENTION

The above and other beneficial objects and advantages are accomplished in accordance with the present invention by a gate apparatus comprising:

(a) a gate member of horizontally elongated rectangular periphery defined by upper and lower edges and first and second vertically disposed ends, and adapted to swing horizontally between open and closed positions, (b) a straight axle affixed to said first vertical end in substantially parallel orientation thereto within the general plane of said gate member, (c) latching means associated with said second vertical edge, (d) a hinge post adapted to be disposed adjacent and parallel to said first vertical end, (e) upper fixed bushing means adapted to rotatively engage the upper extremity of said axle at a fixed distance from said hinge post, (f) lower movable bushing means adapted for rotatively engage said axle adjacent its lower extremity and horizontally movable with respect to said hinge post, (g) a substantially flat cam horizontally disposed below said lower bushing means having rearward and side edges, and a forward edge comprised of two arcuate lobes symmetrically disposed about a center line running between said forward and rearward edges, said lobes meeting in a cusp disposed upon said center line, paired ramps associated with the rearward edge beginning at sites extending beyond said side edges, having flat bottoms coplanar with the lower face of the cam, and terminating in an angled portion directed toward the upper face of the cam, and a circular aperture centered upon said center line adjacent said rearward edge, (h) a cam rod attached to said hinge post in a manner to pivot in a vertical plane above said cam, and having attached to its free extremity a downwardly directed roller adapted to rotate in a horizontal plane in engagement with the edges and ramps of said cam, said roller being adapted to rest in said cusp in the closed position of said gate member, (i) a control rod extending vertically from said lower bushing means and downwardly through the aperture in said cam, (j) spring means extending between said hinge post and control rod, and adapted to urge said rod toward said hinge post, (k) motion dampening means extending between said hinge post and control rod, and (l) paired bump levers rigidly associated with each lobe of said cam and extending from the rearward edge thereof toward the center of each side of said gate member, whereby (m) pressure against either bump lever causes the cam roller to leave the cusp and travel onto the upper face of the cam, causing the lower extremity of the said axle to move away from the hinge post, which action upwardly tilts the gate member so as to disengage from said latching means and swing horizontally to an open position, said spring and motion dampening means causing controlled reversal of said sequence with resultant closing of the gate member.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
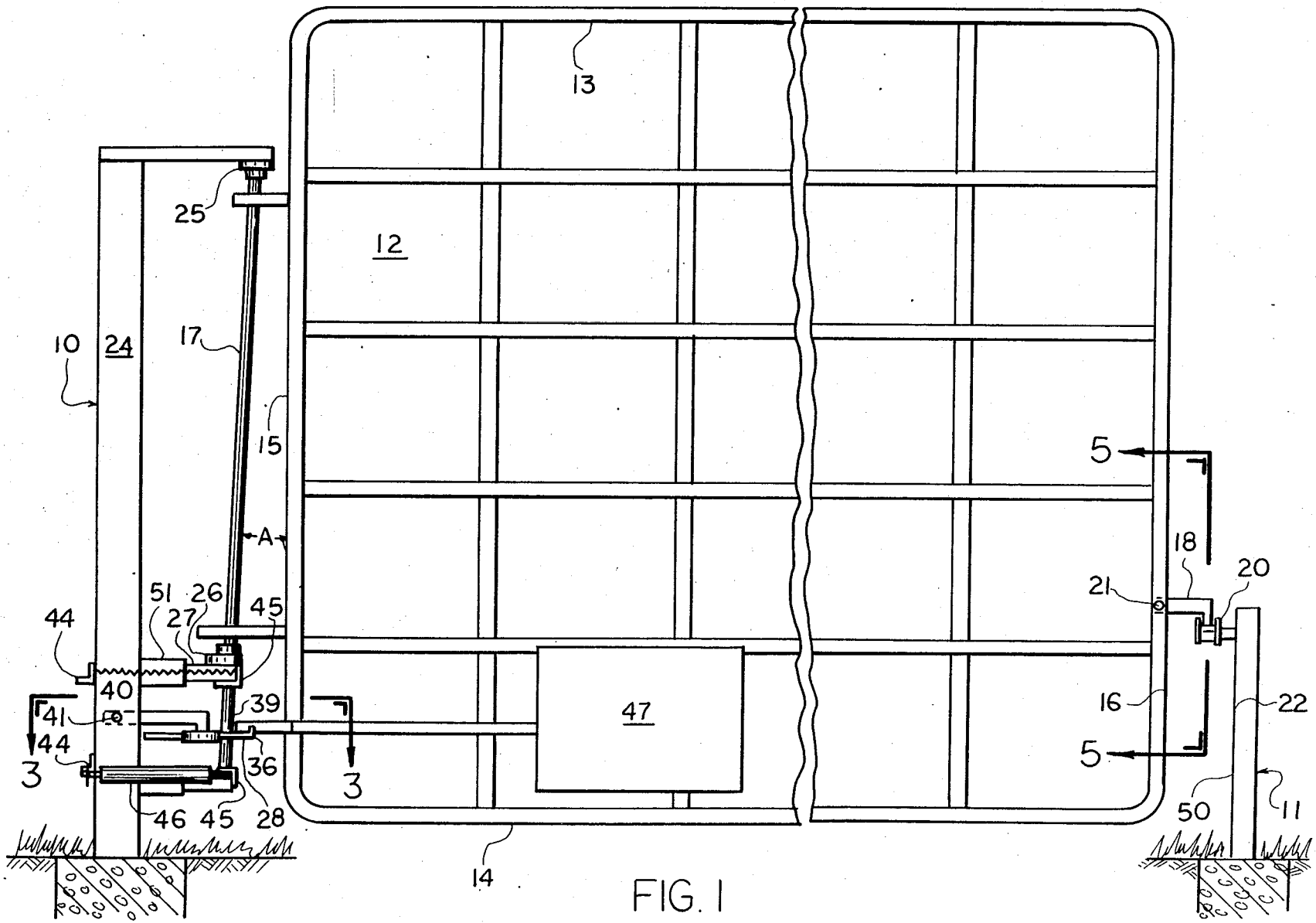
FIG. 1 is a front view of an embodiment of the gate of this invention in its closed position.
Figure 2:
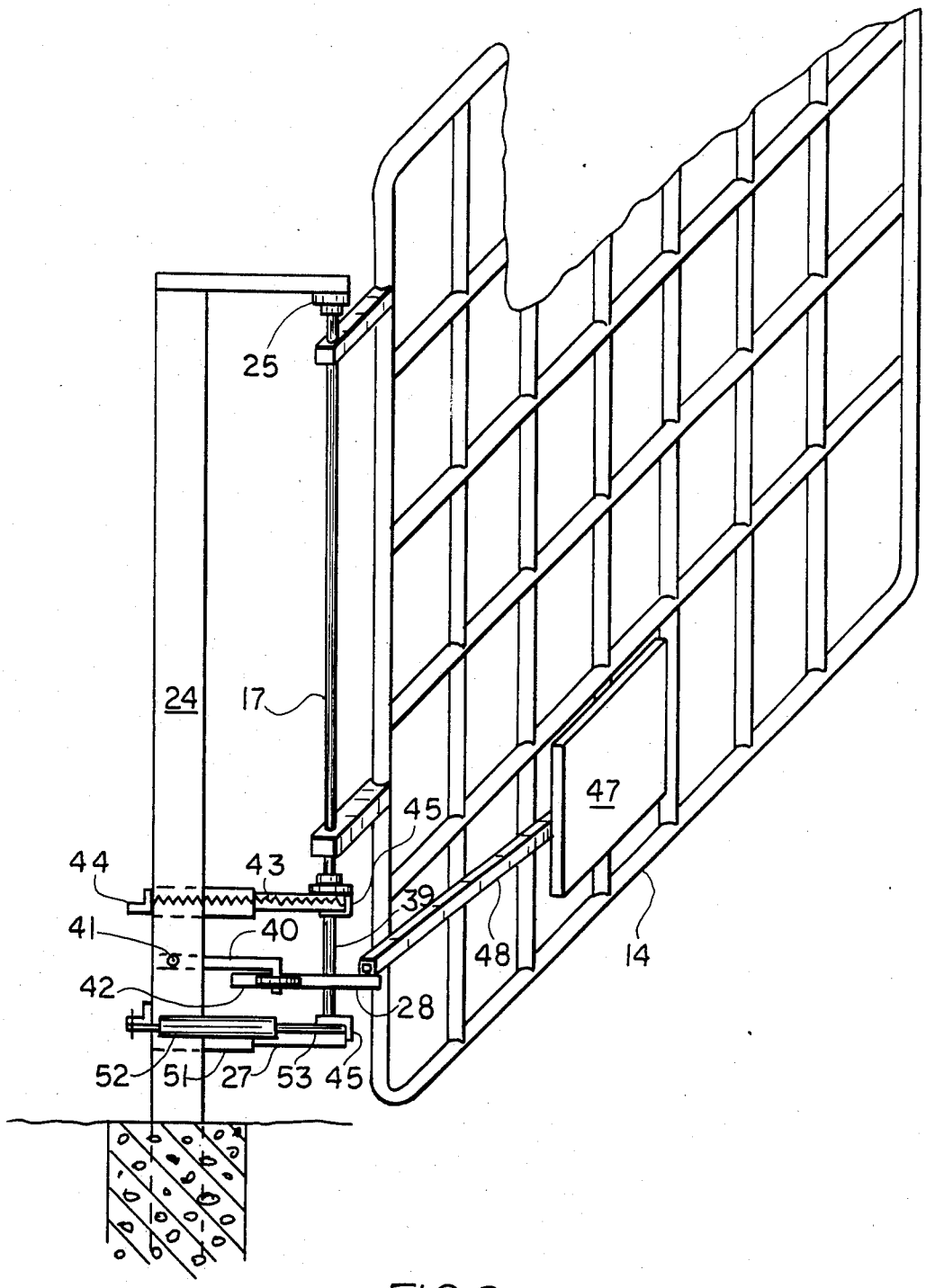
FIG. 2 is a front view of the gate of FIG. 1 in a partially opened position.

Referring to the drawing, an apparatus of the present invention is shown comprised of hinge post assembly 10, latch post assembly 11, and intervening gate member 12 of horizontally elongated rectangular periphery defined by upper and lower edges 13 and 14, respectively, and vertically disposed first and second ends 15 and 16, respectively. The gate member is preferably fabricated of interconnected metal tubing.

A straight axle 17 is affixed to said first vertical end in a manner forming therewith a downwardly opening angle A of about 5 degrees within the general plane of the gate member. A flat latch blade 18 is attached by pivot pin 21 to second end 16 and is adapted to pivot in a vertical plane, permitting entrance into groove 19 in holding arm 20 attached to post 50 of latch post assembly 11. It is to be noted that groove 19 is bounded by angled surfaces 23 which facilitate sliding movement of blade 18 into said groove.

Hinge post assembly 10 is comprised of rigid vertical post 24, fixed upper bushing 25 adapted to rotatively hold the upper extremity of axle 17, and movable lower bushing 26 adapted to rotatively engage the lower extremity of said axle. Said lower bushing is supported by upper square rod 27 which telescopically engages upper square tube 51 held by post 24 and is adapted for reciprocating horizontal movement in the direction of said latch post assembly.

A pair of coil tension springs 43 are disposed on either side of post 24, extending from an upper holding bracket 44 attached to said post to an upper holding bar 45 that perpendicularly attaches to the free extremity of square rod 27. The function of the springs is to urge the lower extremity of axle 17 toward post 24.

A pair of hydraulic piston-cylinder assemblies 46 are disposed below said springs in similar manner and are adapted to slow movement of square rod 27 and associated components toward post 24. The closed extremity of each hydraulic cylinder 52 is attached to lower holding bracket 44 attached to post 24. The free extremity of each piston 53 is attached to a lower holding bar 45 perpendicularly affixed to lower square rod 27 which telescopically engages lower square tube 51 held by post 24.

A control rod 39 extends vertically from beneath lower bushing 26. The upper and lower extremities of said control rod are pivotably held by said upper and lower holding bars, respectively.

A substantially flat cam 28 is horizontally disposed below lower bushing 26, said cam having rearward edge 30, side edges 31, and a forward edge comprised of two side-by-side arcuate lobes 29 symmetrically disposed about center line 32 running between said rearward and forward edges. Said lobes meet in a cusp 33 disposed upon said center line. Paired ramps 34 associated with rearward edge 30 are comprised of a flat bottom surface 35 disposed in coplanar relationship with the lower face of the cam, and upwardly directed retaining lip 36. Each ramp begins with a downwardly angled portion 54 extending beyond said edge 31, and terminates in an upwardly angled portion 37. A circular aperture 38 is centered upon line 32 in close adjacency to rearward edge 30. Control rod 39 extends through aperture 38 in welded engagement therewith, and thereby supports cam 28 in a horizontally pivotable manner.

A cam rod 40 is attached to post 24 by pivot pin 41 which permits movement of the rod in a vertical plane above said cam. A roller 42, adapted to rotate in a horizontal plane, is held by the underside of the free extremity of cam rod 40. The design of the cam rod and roller is such as to enable the roller to bear sideways against said lobes and ride upon said ramps, the roller being adapted to rest in cusp 33 when the gate member is in its closed position.

Paired bump plates 47, disposed in vertical planes and positioned substantially $\frac{1}{4}$ way of the gate member adjacent its lower extremity, are fixedly attached by way of rigid arms 48 to separate lobes of the cam in symmetrical disposition about center line 32. Paired restoring springs 55 extend between each arm 48 and the gate member. Said springs enable the gate member to move between the two bump plates during operation and return to a centered position when latched.

Figure 3:
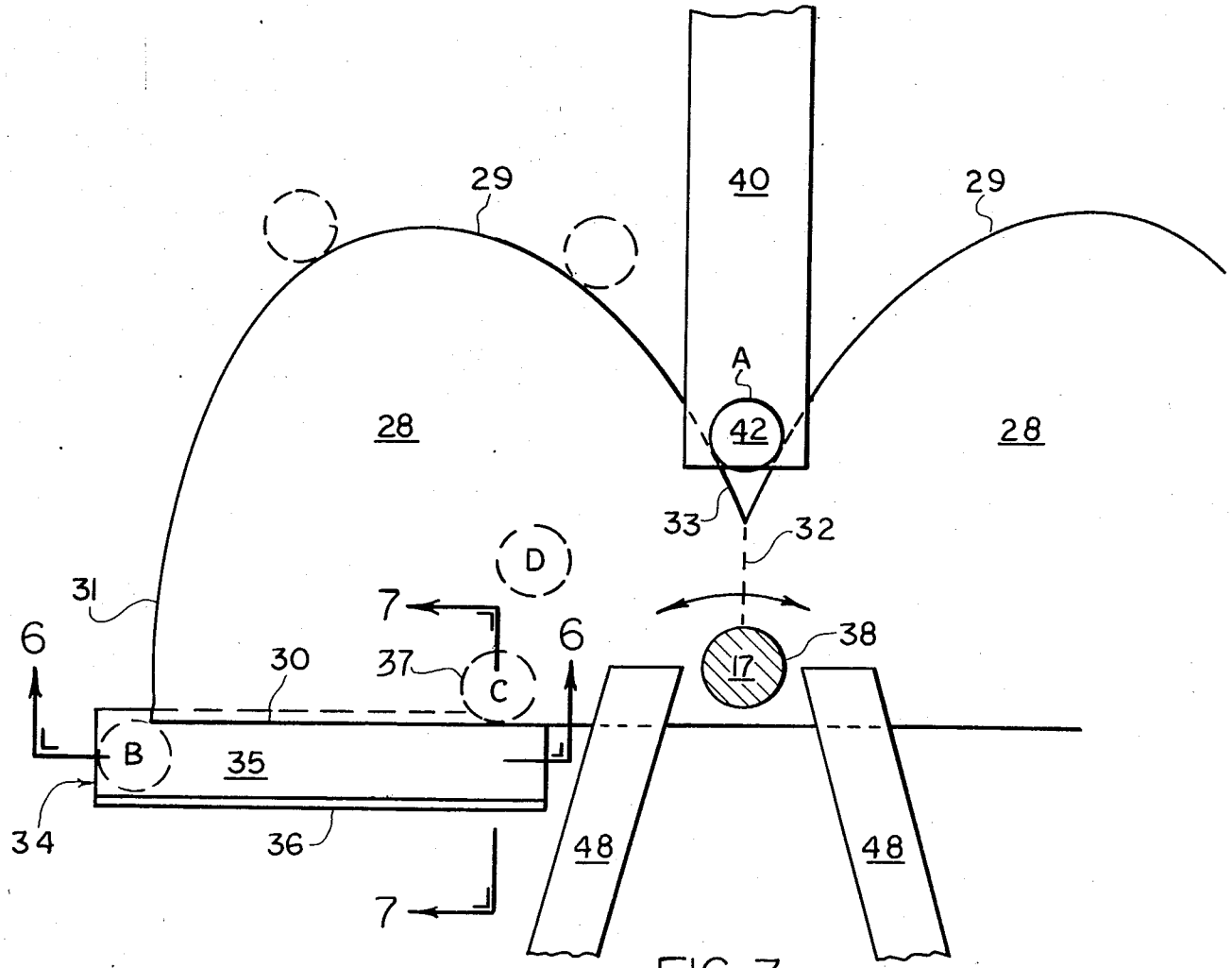
FIG. 3 is an enlarged fragmentary sectional view taken along the line 3—3 of FIG. 1 and showing the path of the cam roller.
Figure 4:
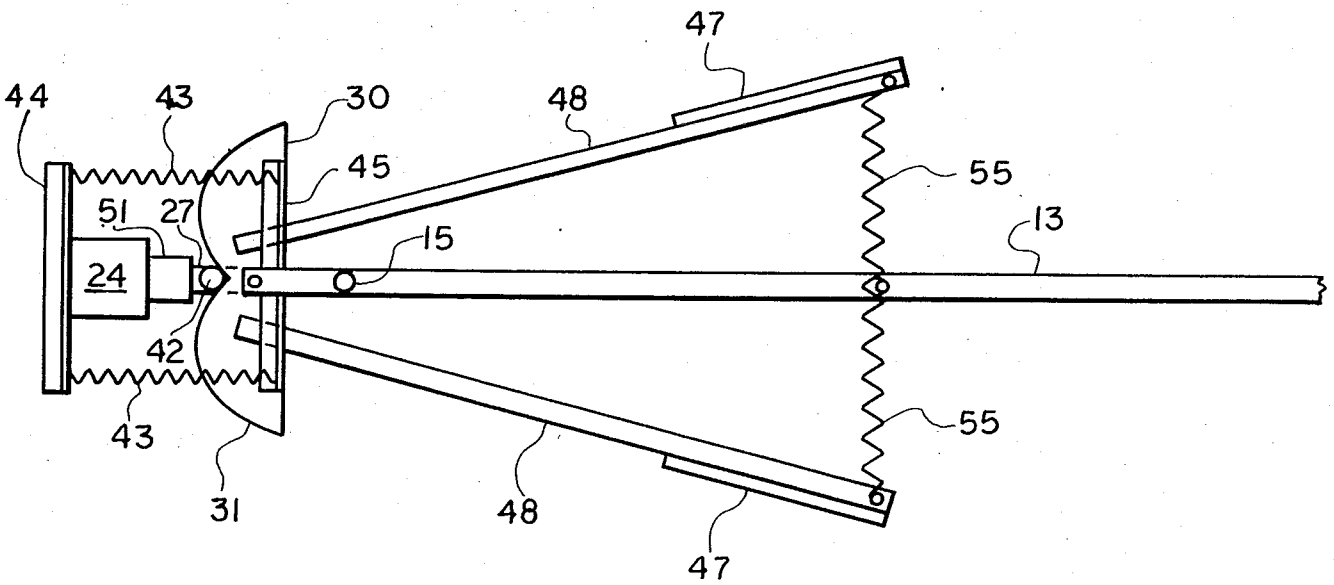
FIG. 4 is a fragmentary top view of the gate of FIG. 1.
Figure 5:
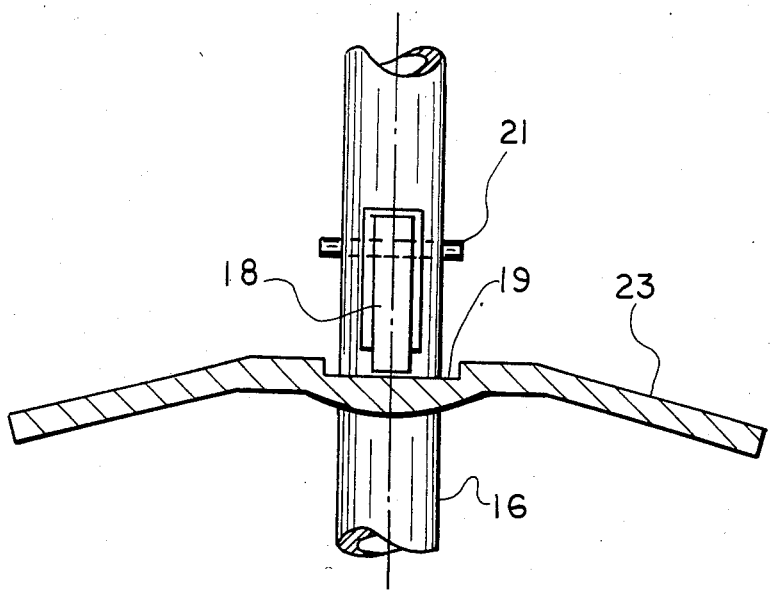
FIG. 5 is an enlarged fragmentary sectional view taken along the line 5—5 of FIG. 1.
Figure 6:
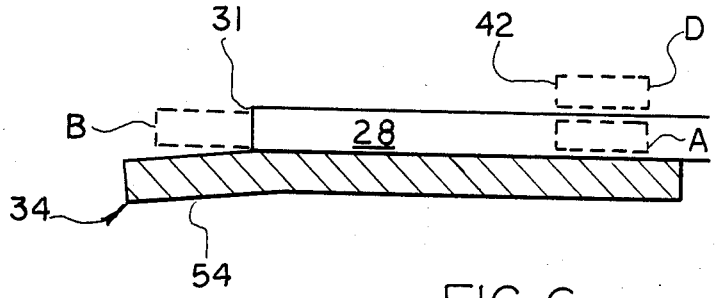
FIG. 6 is a sectional view taken along the line 6—6 of FIG. 3 and showing several positions of the cam roller.
Figure 7:
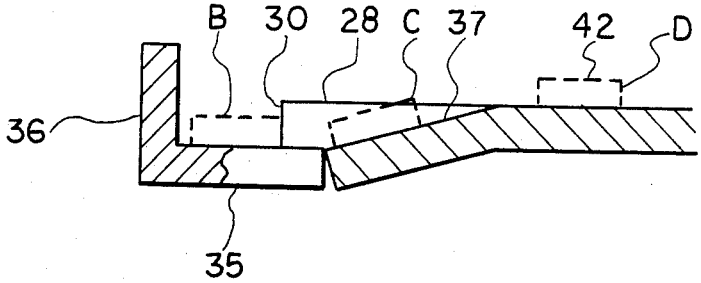
FIG. 7 is a sectional view taken along the line 7—7 of FIG. 3 and showing several positions of the cam roller.

In operation, pressure applied against either bump plate causes the cam roller to leave its position in the cusp, designated as position A in FIGS. 3, 6 and 7. The roller moves around the cam until it enters ramp 34, designated position B. The roller then enters inclined portion 37, designated position C, and is elevated to position D upon the upper surface of cam 28. Such action causes lower extremity of axle 17 to move away from post 24, thereby tilting the gate member upwardly to cause disengagement from the latch post. These effects, and the momentum imparted by the vehicle cause swinging of the gate member to its open position. The energy stored in the open and upwardly tilted gate member causes reversal of said sequence of events to close the gate. The springs function to return the cam back toward post 24, allowing roller 42 to return to the cusp as the gate moves by force of gravity to its lowest, closed position. The duration of the open state can be controlled by adjustment of the tension of the springs and the effectiveness of the hydraulic cylinders. Such factors control the time duration for the roller to move from position B to position C.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Gate apparatus comprising:

(a) a gate member of horizontally elongated rectangular periphery defined by upper and lower edges and first and second vertically disposed ends, and adapted to swing horizontally between open and closed positions, (b) a straight axle affixed to said first vertical end in substantially parallel orientation thereto within the general plane of said gate member, (c) latching means associated with said second vertical end, (d) a hinge post disposed adjacent and parallel to said first vertical end, (e) upper fixed bushing means which rotatively engages the upper extremity of said axle at a fixed distance from said hinge post, (f) lower movable bushing means which rotatively engages said axle adjacent its lower extremity and is horizontally movable with respect to said hinge post, (g) a substantially flat cam horizontally disposed below said lower bushing means, having rearward and side edges and a forward edge comprised of two arcuate lobes symmetrically disposed about a center line running between said forward and rearward edges, said lobes meeting in a cusp disposed upon said center line, and a circular aperture centered upon said center line adjacent said rearward edge, (h) paired ramps associated with the rearward edge of said cam beginning at sites extending beyond the side edges thereof, having flat bottoms coplanar with the lower face of the cam, and terminating in an angled portion directed toward the upper face of the cam, (i) a cam rod attached to said hinge post in a manner to pivot in a vertical plane above said cam, and having attached to its free extremity a downwardly directed roller adapted to rotate in a horizontal plane in engagement with the edges of said cam, said roller being adapted to rest in said cusp in the closed position of said gate member, (j) a control rod extending vertically from said lower bushing means and downwardly through the aperture in said cam, (k) spring means extending between said hinge post and control rod, and adapted to urge said rod toward said hinge post, (l) motion dampening means extending between said hinge post and control rod, and (m) paired arms rigidly associated with each lobe of said cam and extending from the rearward edge thereof toward the center of each side of said gate member, whereby (n) pressure against either arm causes the cam roller to leave the cusp and travel onto the upper face of the cam, causing the lower extremity of the axle to move away from the hinge post, which action upwardly tilts the gate member so as to disengage it from said latching means and swing it horizontally to an open position, whereupon gravity force causes return of the gate member to its closed position, the rate of said opening and closing being controlled by the concertive action of said spring and motion dampening means.

2. The gate apparatus of claim 1 wherein said spring means are paired coil springs mounted upon opposite sides of said hinge posts.

3. The gate apparatus of claim 1 wherein said motion dampening means are paired hydraulic piston-cylinder assemblies mounted upon opposite sides of said hinge post.

4. The gate apparatus of claim 1 wherein said spring means are located above said motion dampening means.

5. The gate apparatus of claim 1 wherein a bump plate is associated with each of said paired arms.

6. The gate apparatus of claim 1 wherein a restoring spring extends between each arm and gate member in a manner to maintain said gate member centered between said arms in the closed position of the gate member.

* * * * *